US010596049B2

(12) United States Patent
Smith

(10) Patent No.: US 10,596,049 B2
(45) Date of Patent: Mar. 24, 2020

(54) WHEELCHAIR PIN PLATFORM GUARD

(71) Applicant: Laura Smith, Byfield, MA (US)

(72) Inventor: Laura Smith, Byfield, MA (US)

( * ) Notice: Subject to any disclaimer, the term of this patent is extended or adjusted under 35 U.S.C. 154(b) by 134 days.

(21) Appl. No.: 15/724,891

(22) Filed: Oct. 4, 2017

(65) Prior Publication Data

US 2018/0133076 A1 May 17, 2018

Related U.S. Application Data

(60) Provisional application No. 62/406,551, filed on Oct. 11, 2016.

(51) Int. Cl.
*A61G 5/10* (2006.01)
*A61G 5/12* (2006.01)

(52) U.S. Cl.
CPC ..... *A61G 5/128* (2016.11); *A61G 5/10* (2013.01)

(58) Field of Classification Search
CPC ..... A61G 5/128; A61G 5/10
See application file for complete search history.

(56) References Cited

U.S. PATENT DOCUMENTS 9,132,050 B1 * 9/2015 Hector, Jr. ..... A61G 5/1043
9,980,864 B2 * 5/2018 Thomas ..... A61G 5/10
10,016,323 B2 * 7/2018 Hall ..... A61G 5/127

* cited by examiner

*Primary Examiner* — Kevin Hurley
*Assistant Examiner* — Marlon A Arce
(74) *Attorney, Agent, or Firm* — Meagher Emanuel Laks Goldberg & Liao, LLP

(57) ABSTRACT

According to some embodiments, a device to be used with a wheelchair having a leg rest support called pin platform is disclosed. The pin platform includes a plate for supporting a detachable leg rest. The device includes a protection cover member having a longitudinal slit adapted to receive the plate of the leg rest support member.

12 Claims, 8 Drawing Sheets

WHEELCHAIR PIN PLATFORM GUARD

CROSS-REFERENCE TO RELATED APPLICATIONS

This application claims priority to provisional application 62/406,551, filed on Oct. 11, 2016, which is herein incorporated by reference in its entirety.

BACKGROUND OF THE INVENTION

The present invention relates generally to wheelchairs and, more particularly, to a protection cover member for a wheelchair with a leg rest support member called Pin Platform.

Most wheelchairs have leg rests that are detachable. The leg rests are removed whenever a patient transfers out of the wheelchair to a chair, bed or to the bathroom. Leg rests are also removed when patients use their feet to propel themselves.

A leg rest support called pin platform remains on the wheelchair frame that was used to support the leg rests. However, a problem occurs when the pin platform plate juts out to the inside frame of the wheelchair when the leg rests are off and have caused open wounds to the legs of patients using the wheelchair. Prior solutions, such as described with respect to FIG. 9, have not been found satisfactory for various reasons.

FIG. 9 shows an example of a solution the nurses have used to protect the patient's legs from injury from the leg rest support plate. They have wrapped towels and Kling Gauze™ or tape around the wheel chair frame to which the leg rest support member is attached to protect the patient's legs. The wraps are not easily applied or removed, are unsanitary and are visually unappealing.

Thus, there is a need for a protecting the legs of a patient in a wheelchair when the leg rests are off and the pin platform plate juts out to the inside frame of the wheelchair.

SUMMARY OF THE INVENTION

According to some embodiments, a device to be used with a wheelchair having an exposed pin platform plate is disclosed. The pin platform includes a plate for supporting a detachable leg rest. The device includes a protection cover member having a longitudinal slit adapted to receive the plate of the pin platform.

According to some embodiments, a method for protecting a user of a wheelchair is disclosed. The wheelchair includes a pin platform, including a plate for supporting a detachable leg rest. The method includes attaching a protection cover member having a longitudinal slit so that the longitudinal slit receives the plate of the pin platform on the wheelchair frame.

Various other features and advantages will be made apparent from the following detailed description and the drawings.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only exemplary embodiments of the invention and are not, therefore, to be considered to be limiting its scope, the invention will be described and explained with additional specificity and detail through the use of the accompanying drawings, in which.

DETAILED DESCRIPTION OF THE INVENTION

According to various embodiments, disclosed herein is a device to be used with a wheelchair having a pin platform member including a plate with an attached peg for supporting a detachable leg rest for protecting a patient's leg. The device includes protection cover member having a longitudinal slit adapted to receive the plate of the pin platform and further includes a hole adapted to receive the peg of the pin platform.

According to various embodiments, disclosed herein is a cushioning protection device that fits onto and is held by the pin platform and covers the leg rest support when the leg rests are removed. The cushioning device provides padding, comfort and is washable, removable and adaptable to various leg rest support sizes.

Figure 1:
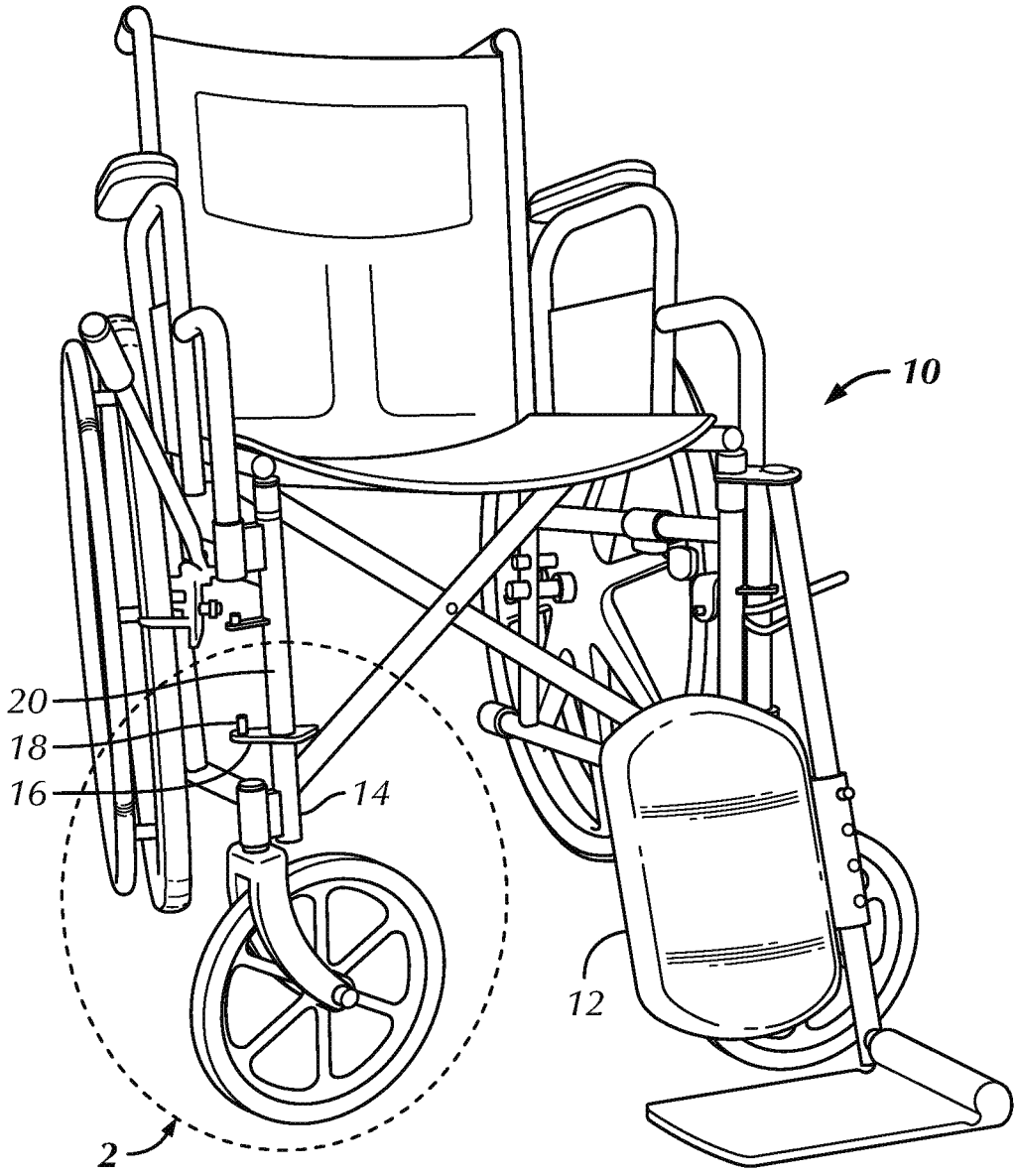
FIG. 1 is a conventional wheelchair; most commonly used but not exclusive to Everett & Jennings

FIG. 1 is a full view of a wheelchair 10 with leg rest 12 on the right. The leg rest 12 is removed on the left to reveal the leg rest support 14 that is a plate member 16 with a peg 18 on the top side. The plate member 16 is attached to tube member 20 of the wheelchair 10 and juts out inside the wheelchair frame so that patients have torn the skin and tissues of their lower leg when they come in contact with it. Some injuries have required emergency room visits and stitches.

Figure 2:
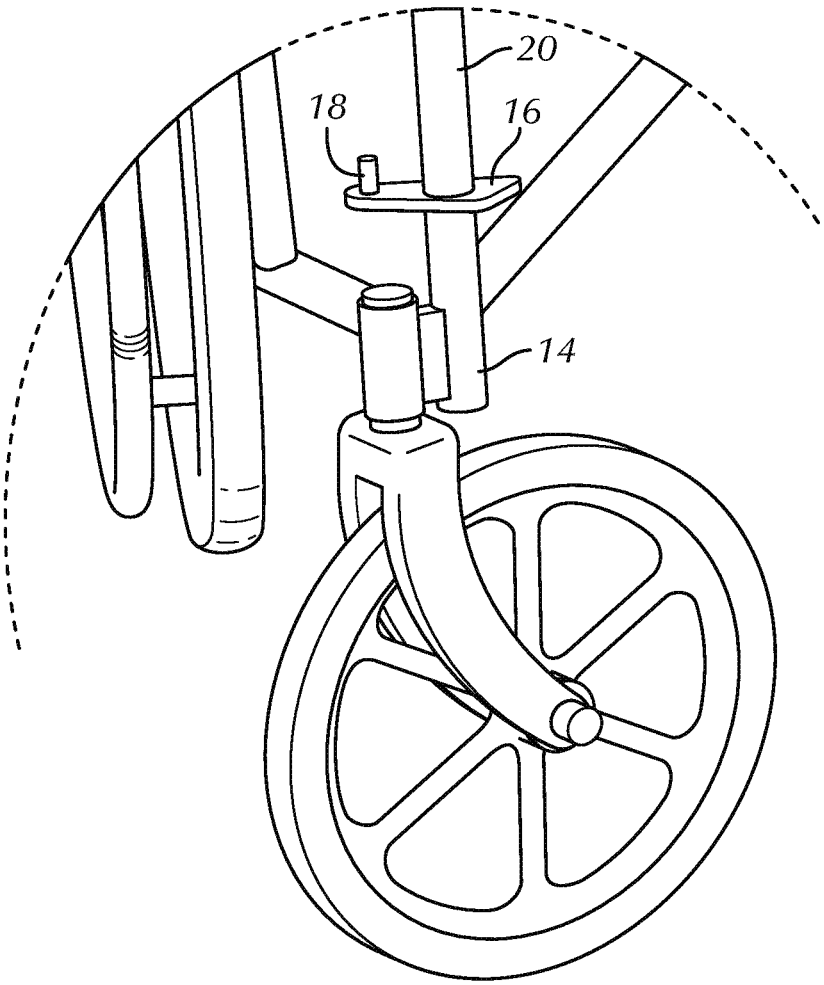
FIG. 2 is a close-up of a leg rest support member called pin platform.

FIG. 2 is a close-up picture of wheelchair pin platform 14 with the leg rest 12 removed. The plate member 16 that juts out to the inside of the wheelchair leg 14 has caused injury.

Figure 3:
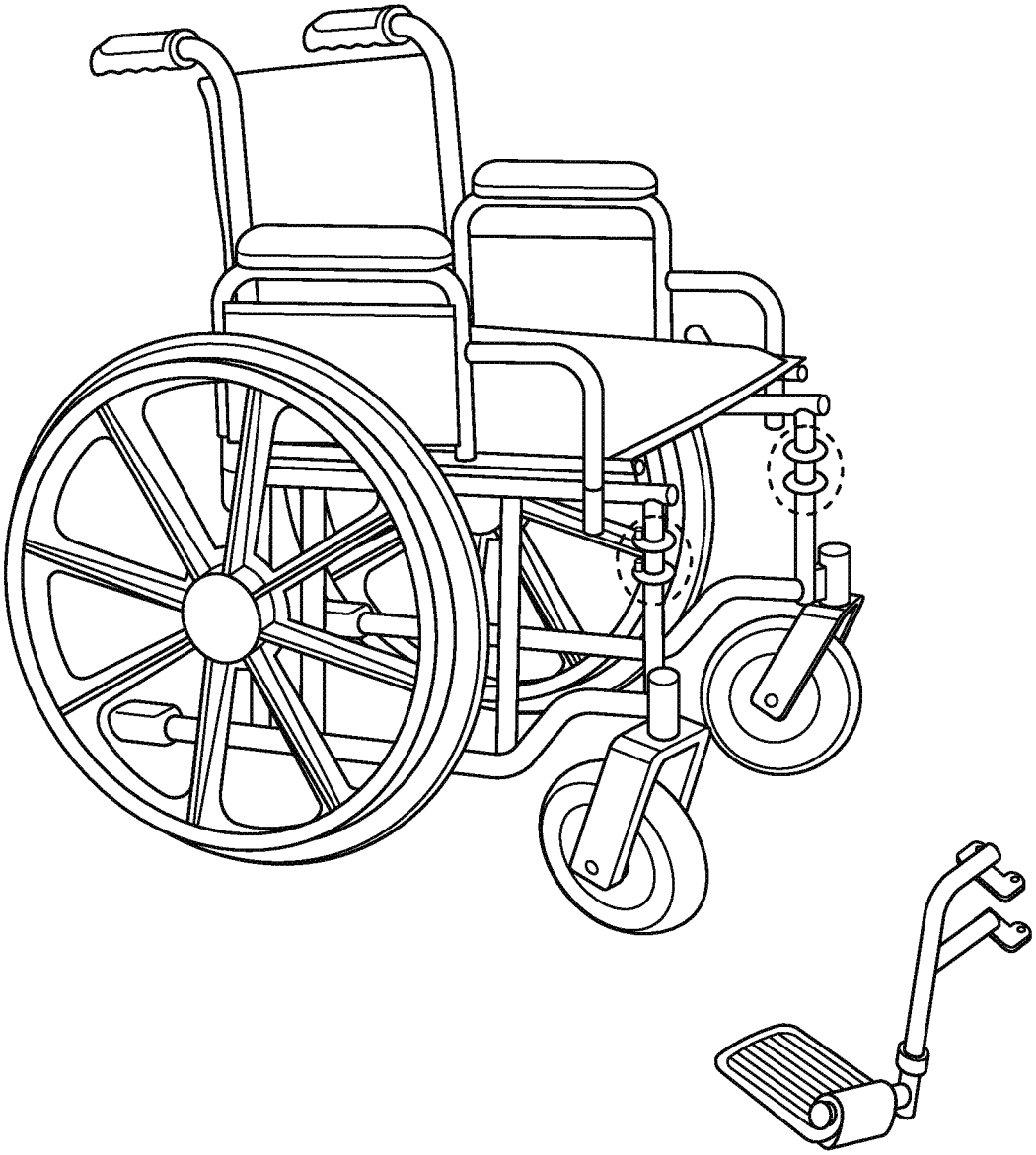
FIG. 3 is a schematic diagram of a wheelchair.

FIG. 3 is a wheelchair diagram that shows various parts of the wheelchair 10. The pin platform plates 14 are indicated in the rectangular boxes. There are two support members 14 visualized in the diagram but only the bottom support member juts out to the inside of the leg of the wheelchair 10. The diagram shows a separate insert of the leg rest 12 and the footrest release latch that attaches the foot/leg rest to front of the wheelchair 10.

Figure 4A:
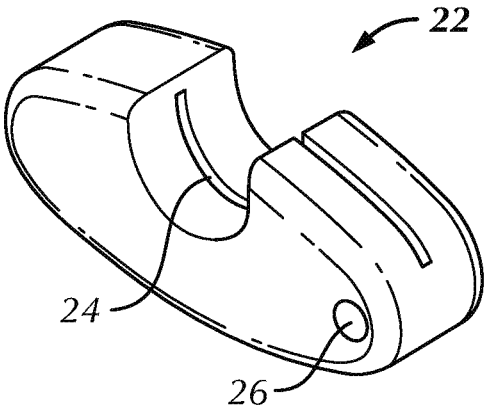
FIGS. 4A-4D are schematic diagrams showing different views of a pin platform cover member for a wheelchair according to an embodiment of the present invention.
Figure 4B:
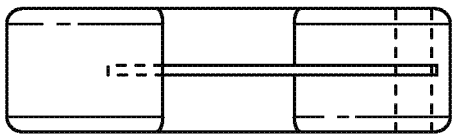
Figure 4C:
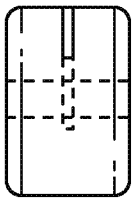
Figure 4D:
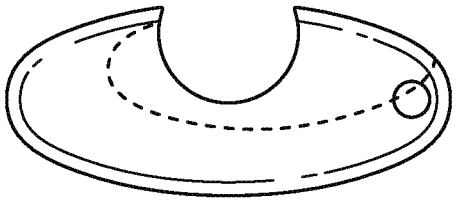

FIGS. 4A-4D are mechanical drawings of cushioning leg rest support protection cover member 22. FIG. 4A is an overall view, FIGS. 4B-4C are side views, and FIG. 4D is a top view. Exemplary dimensions for a protection cover member 22 suitable for use with an Everett & Jennings Transfer Wheelchair, for example, are provided. The dimensions are not intended to be limiting. The protection cover member 22 generally has the shape of the leg rest support member and is sized to accommodate the one of more of the various leg rest support found on wheelchairs. The cushioning protection cover member 22 is sliced longitudinally to provide a slit 24 at or near the middle in the height direction to fit over the leg rest support plate member 16 and includes a hole 26 configured to fit over the peg 18 on the support plate 16 thereby securely holding the protection cover member 22 in place. The protection cover member 22 is formed of any suitable flexible and compressible plastic material or the like and has rounded edges to provide padding and to be comfortable. The flexible material allows the protection cover member 22 to be easily attached and removed. The cover member has sufficient thickness of compressible material between the top and bottom and front side surfaces to provide cushion for the leg of a patient. The hole 26 goes all the way though the protection cover member 22 and the longitudinal slit 24 is located midway between the top and bottom surfaces so that the same configuration of the protection cover member 22 can be used for pin platforms 16 on both left and right sides of the wheelchair. Thus, the device the protection cover member 22 has the same configuration and is symmetrical whether viewed from the top or bottom so it can fit over either a left or right pin plate 16. An elastic attachment member 28 such as a ring like device is provided through the hole 26 to attach the protection cover member 22 to the leg rest 12 or other part of the wheelchair 10 when not in use. The plastic material of the cover member 22 should be repeatedly washable.

Figure 5:
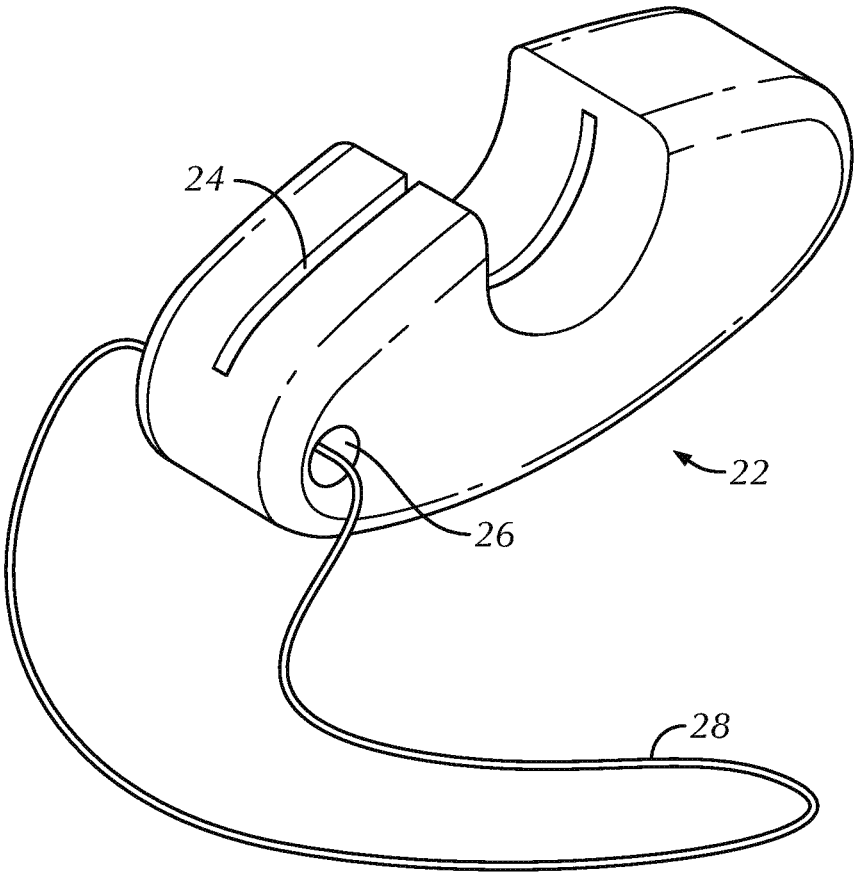
FIG. 5 is a close-up of a protection cover member for a wheelchair according to an embodiment of the present invention.

FIG. 5 is close-up picture of pin platform guard 22 with attachment string 28.

Figure 6:
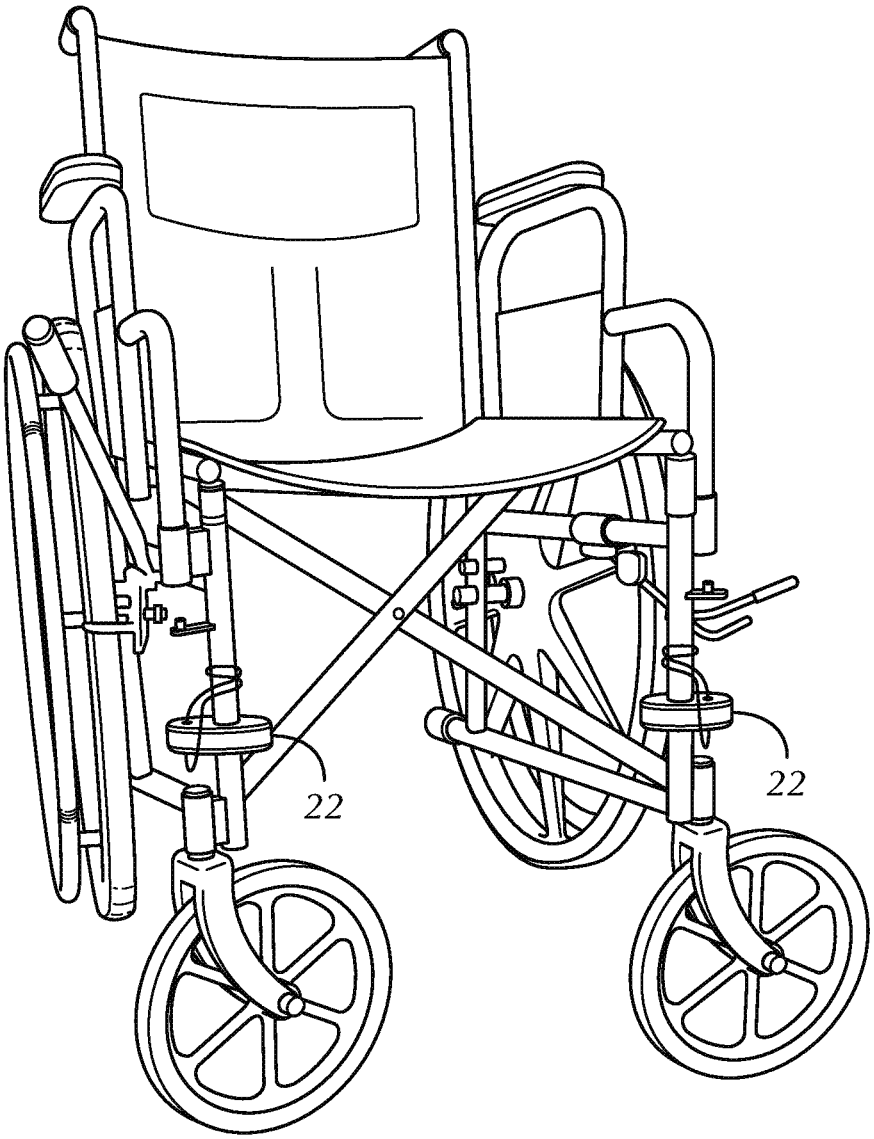
FIG. 6 is a wheelchair with protection cover members attached thereon according to an embodiment of the present invention.

FIG. 6 shows a wheelchair 10 with cushioning cover protection cover members 22 in place over the pin platform plate 14 after the leg rests 12 have been removed. They are secured by placing the holes 26 in the cushioning the over the peg 18 on the support plate 16. There are elastic rings 28 or the like to attach the protection cover members 22 to the wheelchair 10 when in the protection cover members 22 are not in use.

Figure 7:
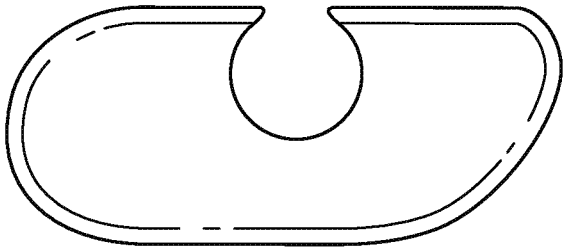
FIG. 7 is a schematic diagram of a pin platform cover member for a wheelchair according to an alternative embodiment of the present invention.

FIG. 7 is a schematic diagram of a pin platform cover member for a wheelchair according to another embodiment of the present invention. It is similar to the embodiment of the invention shown in previous Figures except that it has a less oval shape and has flatter sides as shown on the left and right.

Figure 8:
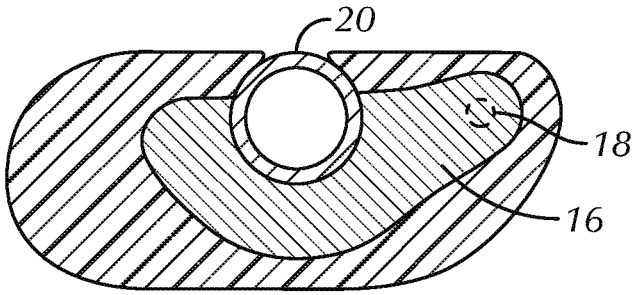
FIG. 8 is a cross-sectional view of the pin platform cover member for a wheelchair according to the alternative embodiment of the present invention.
Figure 9:
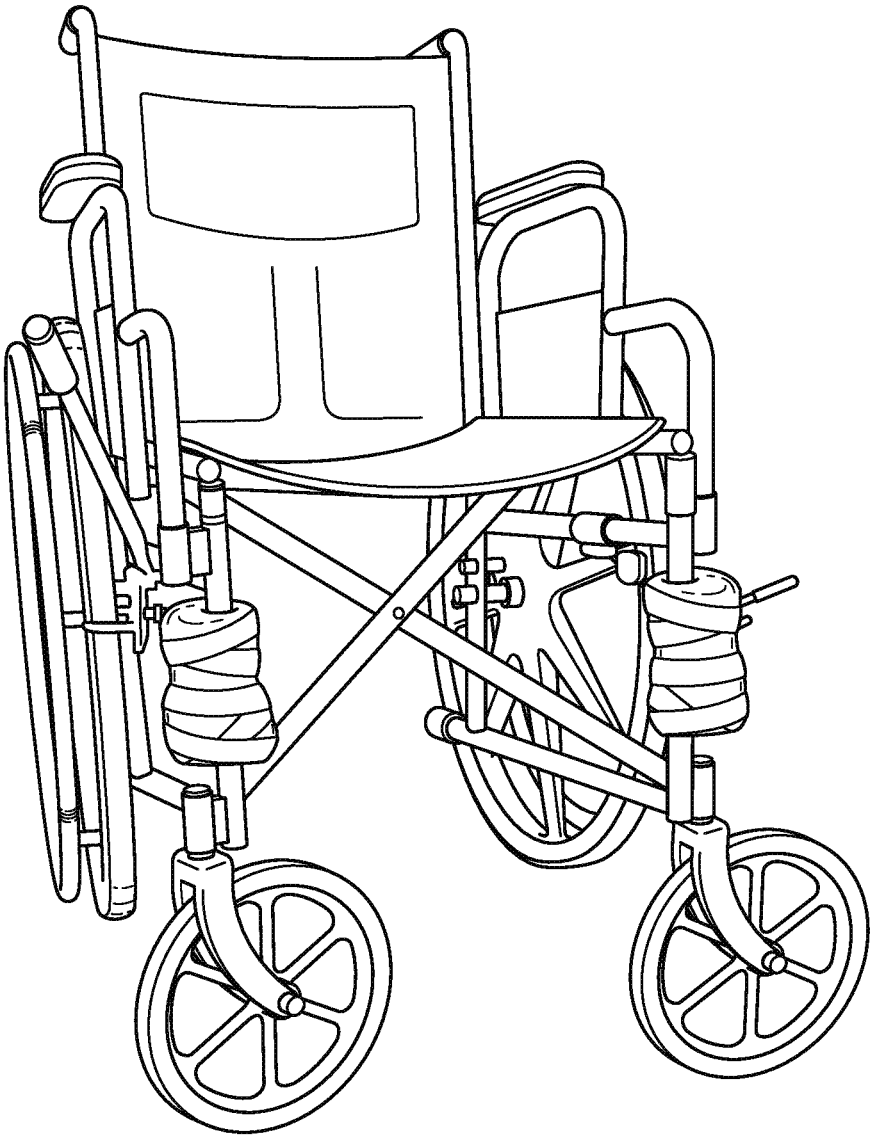
FIG. 9 (Prior Art)
FIG. 9 is an example of an unsuccessful prior art attempt at a solution.

FIG. 8 is a cross-sectional view of the pin platform cover member for a wheelchair according to another embodiment of the present invention shown in FIG. 7. The cross-section is taken at the location of the pin platform 16 with pin 18 that is attached to tube member 20 of the wheelchair. The previously described embodiment of the invention would have a similar cross-section view at the location of the pin platform 16.

It is understood that the above-described embodiments are only illustrative of the application of the principles of the present invention. The present invention may be embodied in other specific forms without departing from its spirit or essential characteristics. All changes that come within the meaning and range of equivalency of the claims are to be embraced within their scope. Thus, while the present invention has been fully described above with particularity and detail in connection with what is presently deemed to be the most practical and preferred embodiment of the invention, it will be apparent to those of ordinary skill in the art that numerous modifications may be made without departing from the principles and concepts of the invention as set forth in the claims.

What is claimed is:

1. A device to be used with a wheelchair having an exposed pin platform including a plate with a peg for supporting a detachable leg rest for protecting a wheelchair user comprising:

a protection cover member having at least approximately the cross-sectional shape of the plate, the protection cover member comprising a partial opening configured to fit over the plate and a hole configured to receive the peg;

the protection cover member comprising a unitary piece of flexible material configured to grasp the plate and peg without assembly mating elements.

2. A device to be used with a wheelchair having a pin platform including a plate for supporting a detachable leg rest for protecting a wheelchair user comprising:

a protection cover member having a longitudinal slit between a top surface and a bottom surface and adapted to receive the plate of the leg rest support member;

the protection cover member comprising a unitary piece of flexible material configured to grasp the plate without assembly mating elements.

3. The device recited in claim 2, wherein the slit is substantially midway between the top surface and the bottom surface.

4. The device recited in claim 2, wherein the protection cover member further includes a hole adapted to receive a peg of the plate of the leg rest support member without assembly mating elements.

5. The device recited in claim 4, wherein the hole extends through the device from the top surface to the bottom surface.

6. The device recited in claim 2, wherein the protection cover member further includes an attachment element for securing the protection member to wheel chair when not in use.

7. The device recited in claim 2, wherein the protection cover member is made of a compressible material and of thickness relative to the top surface, the bottom surface and a front surface to protect the leg of a user.

8. The device recited in claim 2, wherein the protection cover member is made of washable material.

9. The device recited in claim 2, wherein the protection cover member has rounded edges.

10. The device recited in claim 2, wherein the protection cover member has the same configuration whether viewed from the top or bottom so it can fit over either a left or right pin plate.

11. A method for protecting a user of a wheelchair having a pin platform including a plate for supporting a detachable leg rest comprising:

attaching a protection cover member having at least approximately the cross-sectional shape of the plate and a longitudinal slit so that the longitudinal slit receives the plate of the pin platform;

the protection cover member comprising a unitary piece of flexible material configured to grasp the plate without assembly mating elements.

12. The method recited in claim 11, wherein:

the protection cover member further includes a hole adapted to receive a peg of the plate of the pin platform; and attaching the protection cover member further includes inserting the peg of the plate of the pin platform through the hole in the protection member.

* * * * *